US010437183B1

(12) United States Patent
Tanaka

(10) Patent No.: US 10,437,183 B1
(45) Date of Patent: Oct. 8, 2019

(54) FIXING DEVICE THAT ENABLES SETTING OF POSITION OF CLAW MEMBER OF FIXING DEVICE IN ACCORDANCE WITH KIND OF SHEET, AND IMAGE FORMING APPARATUS INCLUDING THE SAME

(71) Applicant: Kyocera Document Solutions Inc., Osaka (JP)

(72) Inventor: Yuichiro Tanaka, Osaka (JP)

(73) Assignee: Kyocera Document Solutions Inc., Osaka (JP)

( * ) Notice: Subject to any disclaimer, the term of this patent is extended or adjusted under 35 U.S.C. 154(b) by 0 days.

(21) Appl. No.: 16/120,334

(22) Filed: Sep. 3, 2018

(51) Int. Cl.
*G03G 15/20* (2006.01)

(52) U.S. Cl.
CPC ..... *G03G 15/2028* (2013.01)

(58) Field of Classification Search
CPC ..... G03G 15/2028
See application file for complete search history.

(56) References Cited

U.S. PATENT DOCUMENTS

2012/0020681 A1* 1/2012 Naitoh ..... G03G 15/2028 399/21
2013/0108335 A1* 5/2013 Nagata ..... G03G 15/2025 399/323

FOREIGN PATENT DOCUMENTS

JP 2003-076203 A 3/2003
JP 2005-308955 A 11/2005
JP 2009-258396 A 11/2009

* cited by examiner

*Primary Examiner* — Sandra Brase
(74) *Attorney, Agent, or Firm* — James Judge

(57) ABSTRACT

A fixing device includes a fixing member, a pressure member, and a separating unit. The pressure member is rotatably located and in a pressure contact with the fixing member to form a fixing nip. The separating unit is configured to separate a sheet from the fixing member. The sheet is attached on the fixing member when passing through the fixing nip. The separating unit includes a sliding member, a claw member, and a turning mechanism. The sliding member is located in a state of contacting a surface of the fixing member. The claw member runs toward the fixing nip from the sliding member. The claw member has a distal end portion. The claw member is located in a state where the distal end portion contacts the surface of the fixing member. The turning mechanism reciprocates the sliding member and the claw member along a rotation direction of the fixing member.

6 Claims, 7 Drawing Sheets

FIXING DEVICE THAT ENABLES SETTING OF POSITION OF CLAW MEMBER OF FIXING DEVICE IN ACCORDANCE WITH KIND OF SHEET, AND IMAGE FORMING APPARATUS INCLUDING THE SAME

STATEMENT REGARDING PRIOR DISCLOSURES BY THE INVENTOR OR A JOINT INVENTOR

Japanese Unexamined Pat. App. Pub. No. 2017-156605, a copy of which is included in the application that this specification is the basis of, is a grace-period inventor disclosure subject to the exceptions of 35 U.S.C. § 102(b)(1)(A), as having been made by the same inventive entity as that of this specification.

BACKGROUND

Unless otherwise indicated herein, the description in this section is not prior art to the claims in this application and is not admitted to be prior art by inclusion in this section.

A typical image forming apparatus using an electrophotographic method includes a fixing device having a pressure roller that is brought into pressure contact with a fixing roller. The fixing device applies pressure and heat to sheets passing between the two rollers (through a fixing nip) to fix toner images on the sheets (fixing process). The sheets enter the fixing nip while the surface on which the toner image is transferred is opposed to the fixing roller side.

Sheets having passed through the fixing nip can become wound around the fixing roller due to the viscousness of the melted toner. On this account, the fixing device includes a separation claw in constant contact with the surface of the fixing roller. This separation claw prevents a sheet from becoming wound around the fixing roller after the fixing process. A problem, however, is that the separation claw being constantly in contact with (slidably contacting) the fixing roller makes the fixing roller liable to being abraded.

There is proposed a technique to solve the above-described problem. For example, there is proposed a fixing device including a mechanism (solenoid) that causes a separation claw to contact and be separated from a fixing roller. This mechanism is controlled such that the separation claw contacts the fixing roller only when the fixing process is performed.

SUMMARY

A fixing device according to one aspect of the disclosure includes a fixing member, a pressure member, and a separating unit. The fixing member is rotatably located. The fixing member is heated by a heat source. The pressure member is rotatably located. The pressure member is in a pressure contact with the fixing member to form a fixing nip. The separating unit is configured to separate a sheet from the fixing member. The sheet is attached on the fixing member when passing through the fixing nip. The separating unit includes a sliding member, a claw member, and a turning mechanism. The sliding member is located in a state of contacting a surface of the fixing member. The claw member runs toward the fixing nip from the sliding member. The claw member has a distal end portion. The claw member is located in a state where the distal end portion contacts the surface of the fixing member. The turning mechanism reciprocates the sliding member and the claw member along a rotation direction of the fixing member.

These as well as other aspects, advantages, and alternatives will become apparent to those of ordinary skill in the art by reading the following detailed description with reference where appropriate to the accompanying drawings. Further, it should be understood that the description provided in this summary section and elsewhere in this document is intended to illustrate the claimed subject matter by way of example and not by way of limitation.

DETAILED DESCRIPTION

Figure 1:
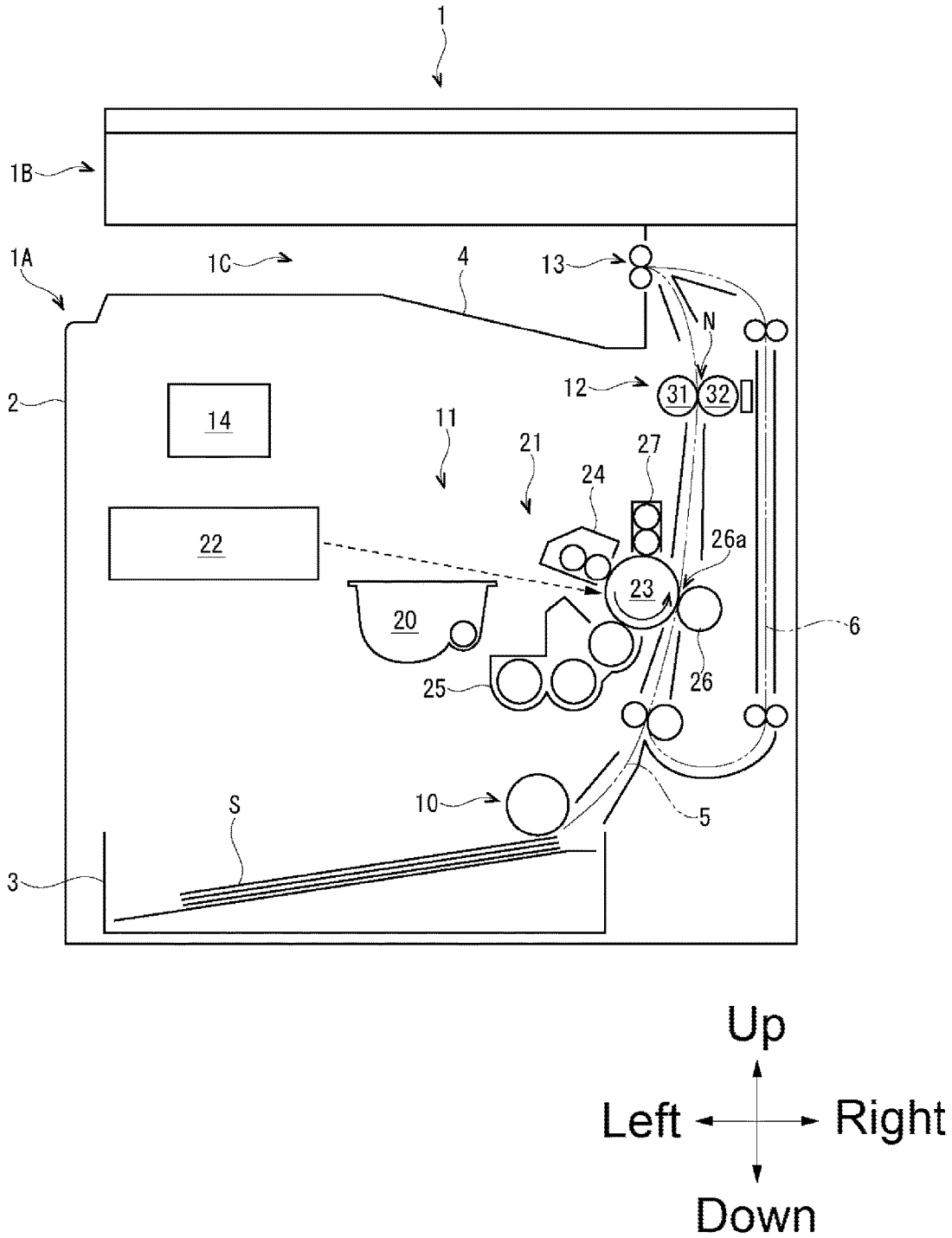
FIG. 1 schematically illustrates a cross section of an internal structure of a multi-functional peripheral according to one embodiment of the disclosure.

Example apparatuses are described herein. Other example embodiments or features may further be utilized, and other changes may be made, without departing from the spirit or scope of the subject matter presented herein. In the following detailed description, reference is made to the accompanying drawings, which form a part thereof.

The example embodiments described herein are not meant to be limiting. It will be readily understood that the aspects of the present disclosure, as generally described herein, and illustrated in the drawings, can be arranged, substituted, combined, separated, and designed in a wide variety of different configurations, all of which are explicitly contemplated herein.

The following describes a preferred embodiment of the disclosure with reference to the accompanying drawings. Hereinafter, paper-surface-front sides in FIGS. 1, 3, 5, and 7 are defined as a front surface, and the preferred embodiment of the disclosure is described using directions indicated in the respective drawings as a reference. In the following description, a term of "conveyance direction" means a conveyance direction of a sheet S. Further, "upstream," "downstream," and terms similar to these mean an "upstream" and a "downstream" of the conveyance direction, and a concept similar to these.

The following describes a multi-functional peripheral 1 as an image forming apparatus with reference to FIG. 1. FIG. 1 schematically illustrates a cross section of an internal structure of the multi-functional peripheral 1.

The multi-functional peripheral 1 includes a printing device 1A and a scanning device 1B. The printing device 1A forms images on the sheet S using an electrophotographic method. The scanning device 1B includes components (not illustrated) that optically read image information of an original document. The scanning device 1B is located above the printing device 1A across an in-barrel space 1C. The scanning device 1B has a known structure, and thus the following omits the detailed description.

The printing device 1A includes an apparatus main body 2, a sheet feed cassette 3, and a sheet discharge tray 4. The sheet feed cassette 3 is located in a lower portion of the apparatus main body 2 and is removably attachable in a front-rear direction. The sheet feed cassette 3 houses paper (a bundle of) sheets S. The sheet discharge tray 4 is located on a top surface of the apparatus main body 2 (a bottom surface of the in-barrel space 1C).

Inside the apparatus main body 2, a main conveyance path 5 and an inverting conveyance path 6 are formed. The main conveyance path 5 vertically runs from the sheet feed cassette 3 to the sheet discharge tray 4. The inverting conveyance path 6 vertically runs so as to communicate between an upstream portion and a downstream portion of the main conveyance path 5.

The printing device 1A includes a paper sheet feeder 10, an image forming unit 11, a fixing device 12, a discharging roller pair 13, and a control device 14. The paper sheet feeder 10 is located in an upstream end portion of the main conveyance path 5. The paper sheet feeder 10 conveys the sheets S from the sheet feed cassette 3 one by one to the main conveyance path 5. The image forming unit 11 and the fixing device 12 are located in an intermediate portion of the main conveyance path 5. The discharging roller pair 13 is located on a downstream end portion of the main conveyance path 5. The control device 14 (control unit) integrally controls operations of the multi-functional peripheral 1.

The image forming unit 11 transfers a toner image on the sheet S. The image forming unit 11 includes a toner container 20, a drum unit 21, and a light scanning device 22. The toner container 20 houses, for example, a black toner (developer). The drum unit 21 includes a photoreceptor drum 23, a charging apparatus 24, a developing device 25, a transfer roller 26, and a cleaning apparatus 27. The charging apparatus 24, the developing device 25, the transfer roller 26, and the cleaning apparatus 27 are located in a peripheral area of the photoreceptor drum 23 in order of the transfer process. The transfer roller 26 is brought into pressure contact with the photoreceptor drum 23 from a lower side to form a transfer nip 26*a*.

While the details will be described later, the fixing device 12 includes a pressure roller 32 that is brought into pressure contact with a fixing roller 31 to form a fixing nip N. The fixing device 12 heats the sheet S passing through the fixing nip N to fix the toner image on the sheet S while applying pressure.

Here, the following describes operations of the printing device 1A. The control device 14 performs an image formation process based on, for example, image data read by the scanning device 1B as follows.

The charging apparatus 24 charges a surface of the photoreceptor drum 23. The light scanning device 22 performs exposure (see the dashed line arrow in FIG. 1) in accordance with the image data on the photoreceptor drum 23. The developing device 25 develops an electrostatic latent image on the photoreceptor drum 23 into the toner image. On the other hand, the sheet S is transmitted to the main conveyance path 5 from the paper sheet feeder 10. The toner image is transferred on a surface of the sheet S passing through the transfer nip 26*a*. The fixing device 12 fixes the toner image on the surface of the sheet S. After a fixing process, the sheet S is discharged on the sheet discharge tray 4 by the discharging roller pair 13.

When image formations (duplex printing) are performed on both the front and back surfaces of the sheet S, the sheet S is reversely conveyed by the discharging roller pair 13 to be conveyed to the inverting conveyance path 6 after the fixing process. After that, similarly to the above, the transfer and the fixing process of toner images are performed on the back surface of the sheet S. Then, the sheet S, on which the duplex printing has been performed, is discharged on the sheet discharge tray 4.

Figure 2:
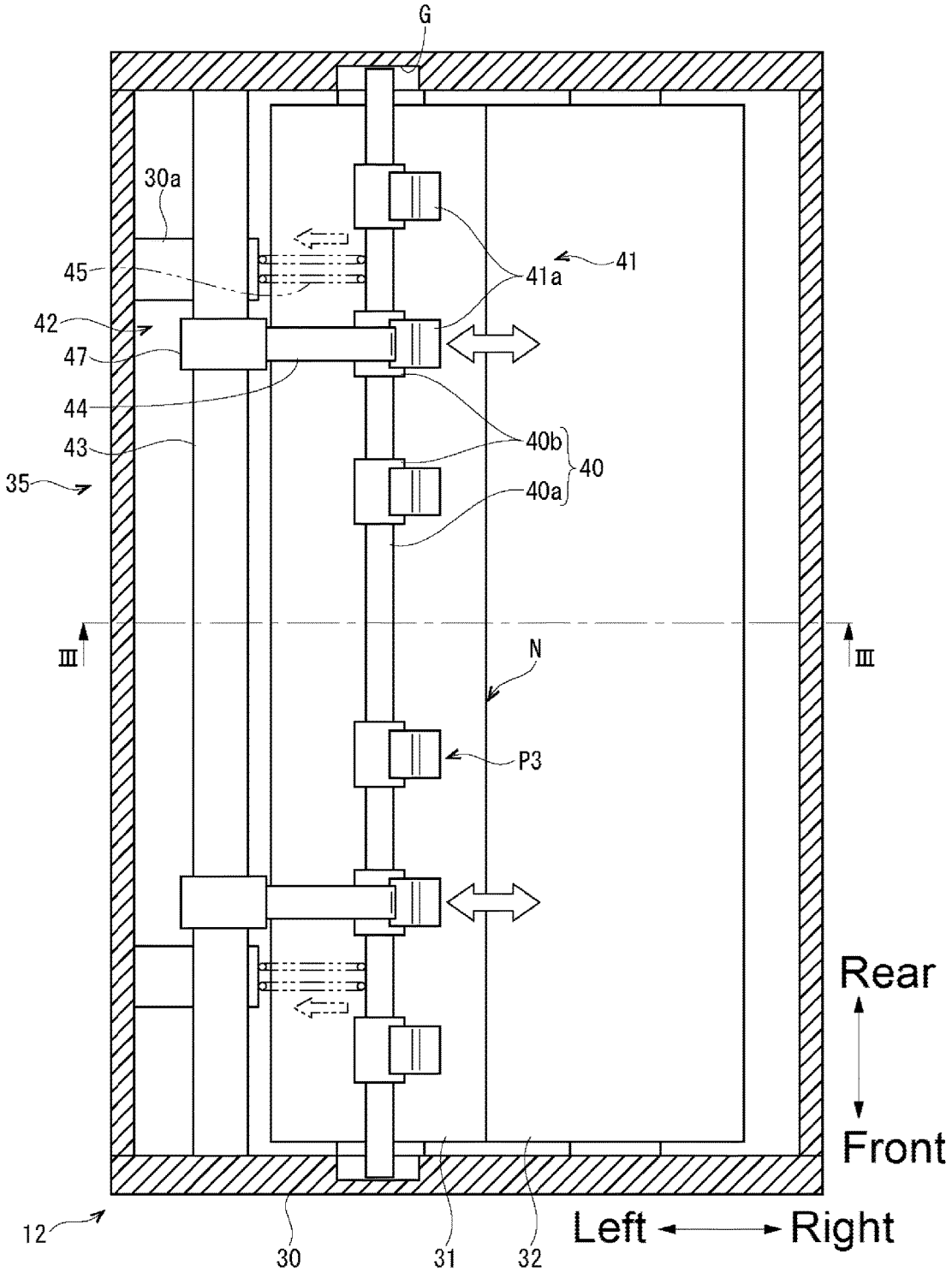
FIG. 2 schematically illustrates a planar view of an internal structure of a fixing device according to the one embodiment.
Figure 3:
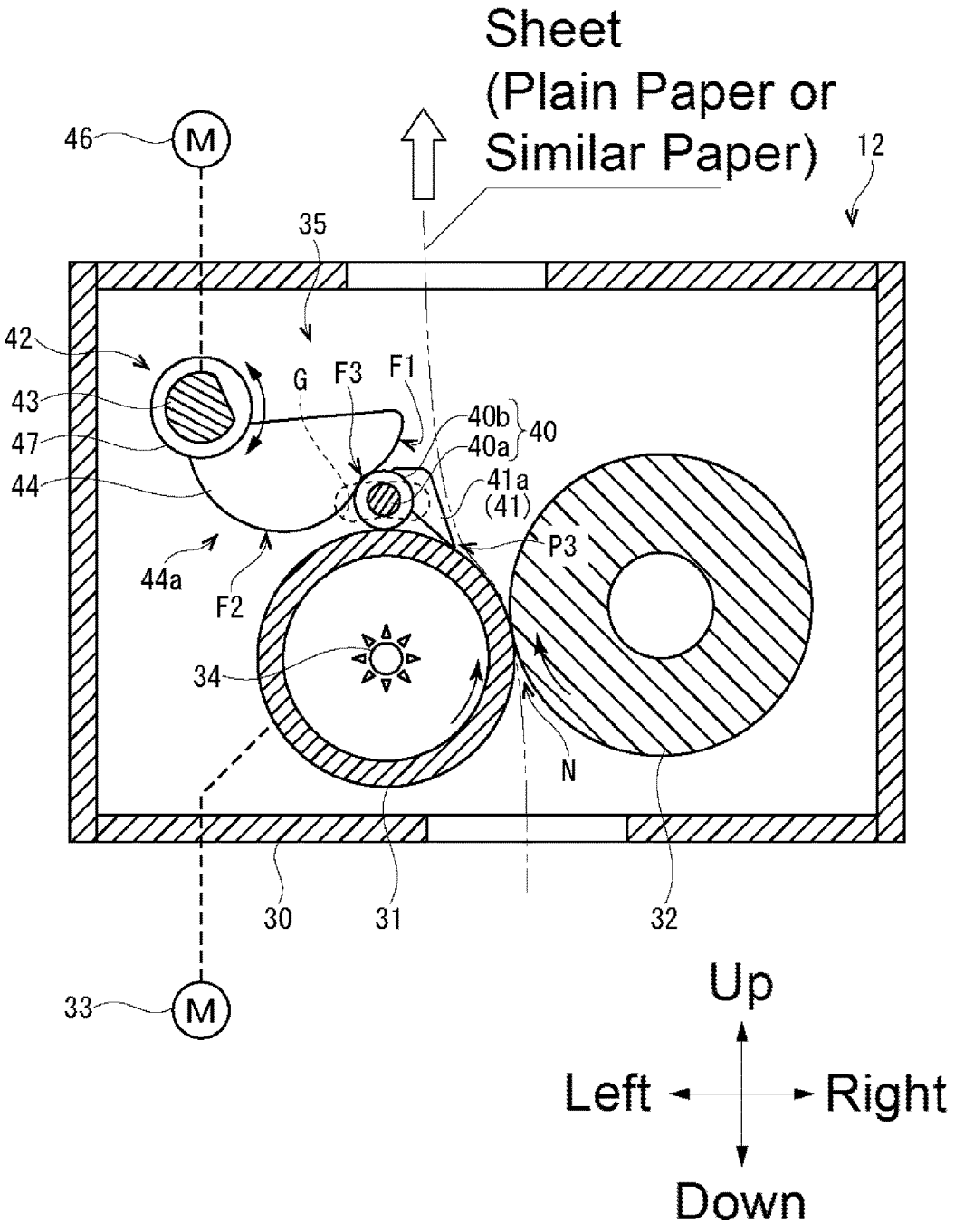
FIG. 3 illustrates a cross-sectional view taken along the line III-III in FIG. 2.
Figure 4:
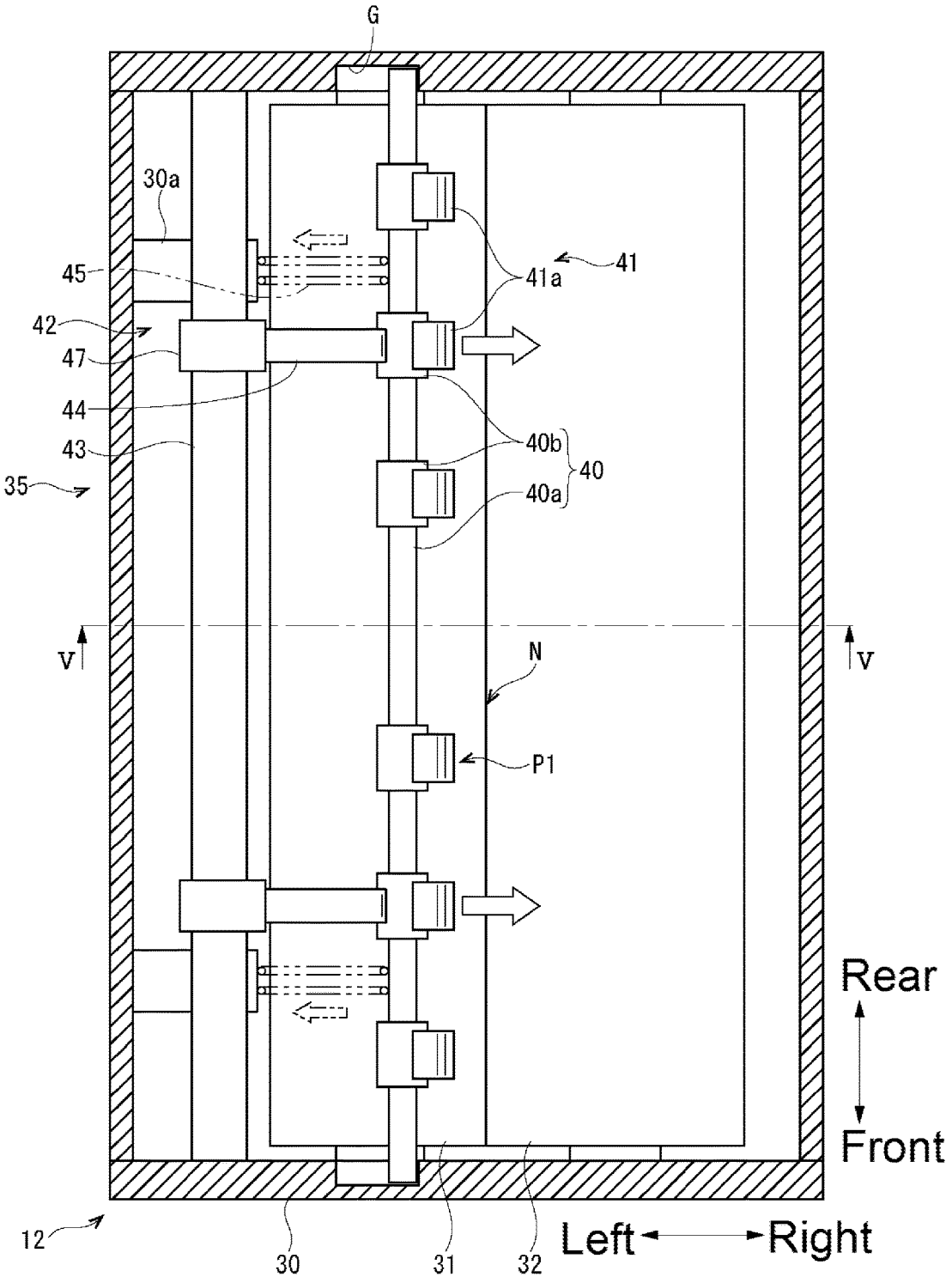
FIG. 4 schematically illustrates a planar view of an internal structure of the fixing device according to the one embodiment, and illustrates a state where a claw member and similar member are close to a fixing nip.
Figure 5:
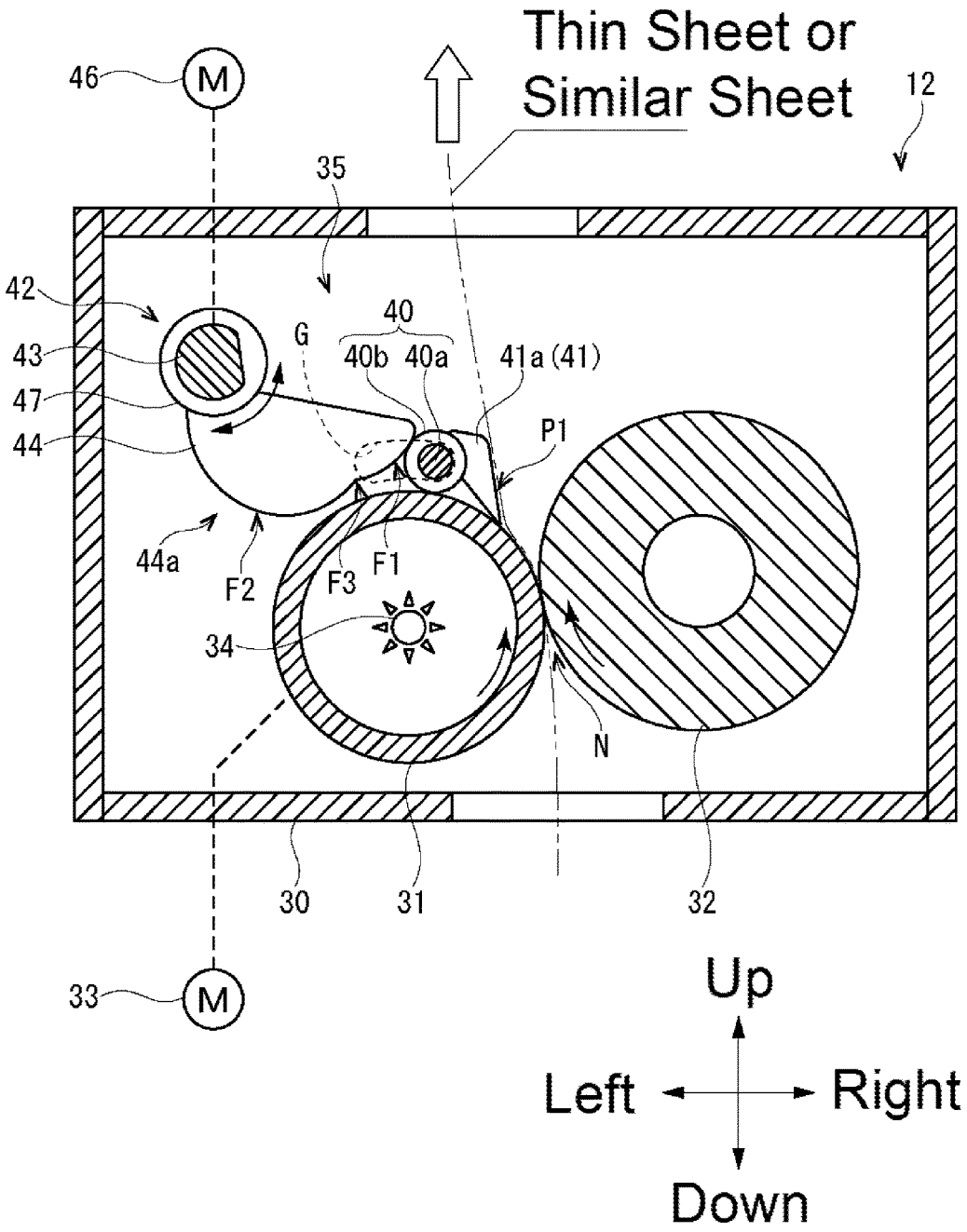
FIG. 5 illustrates a cross-sectional view taken along the line V-V in FIG. 4.
Figure 6:
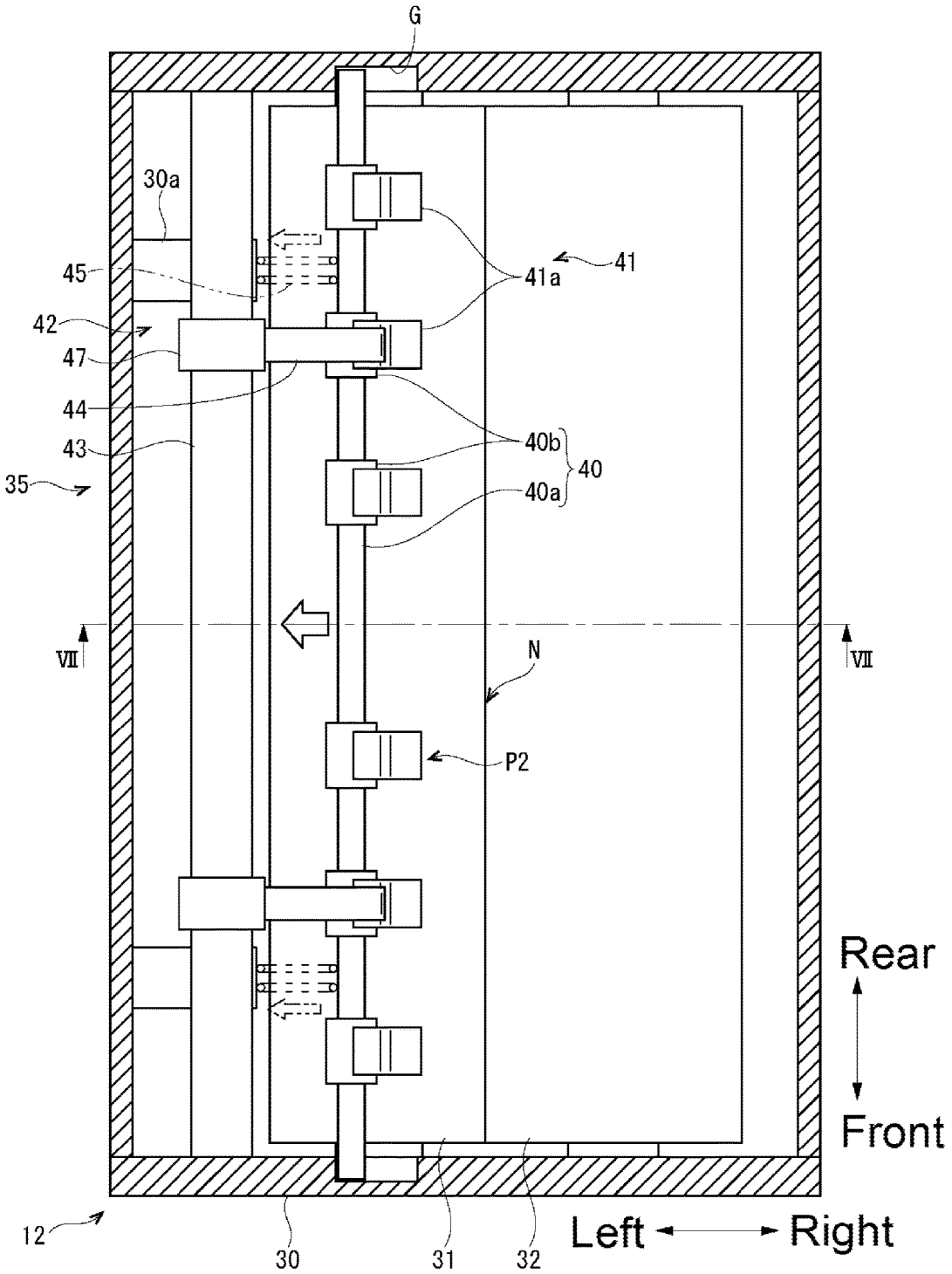
FIG. 6 schematically illustrates a planar view of an internal structure of the fixing device according to the one embodiment, and illustrates a state where the claw member and similar member are separated from the fixing nip.
Figure 7:
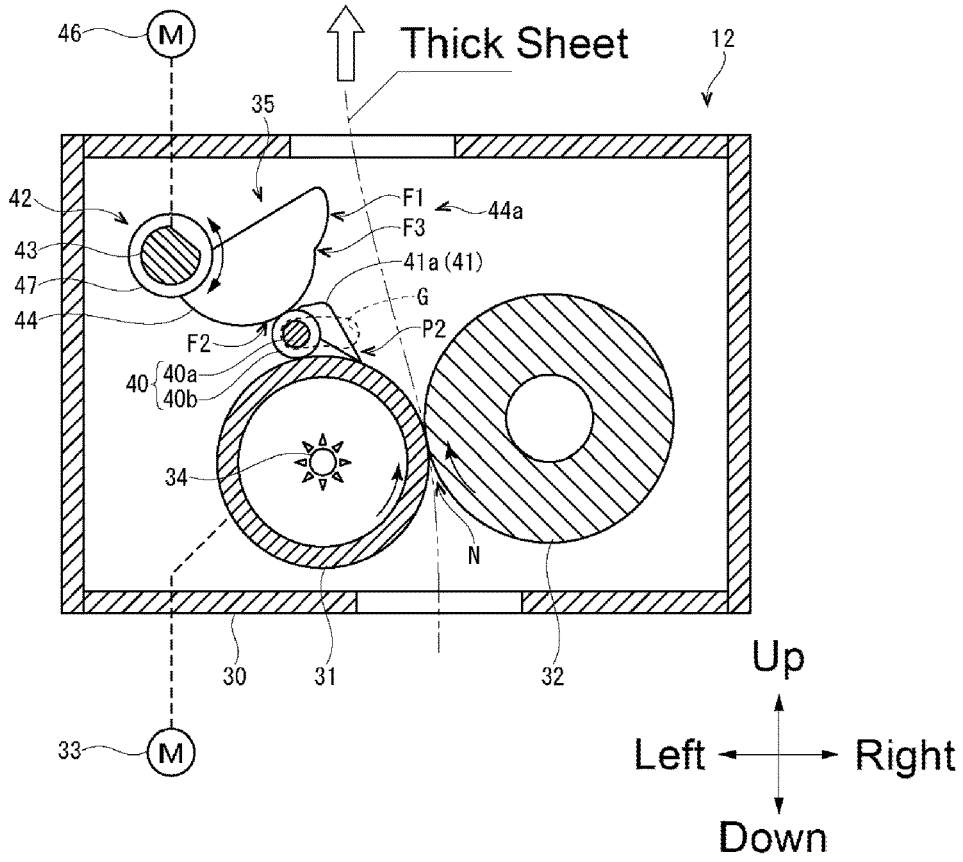
FIG. 7 illustrates a cross-sectional view taken along the line VII-VII in FIG. 6.
Figure 8:
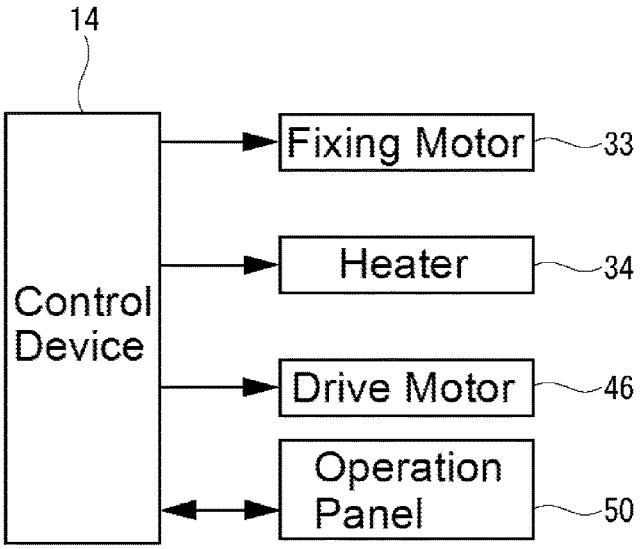
FIG. 8 illustrates a block diagram of a control system of the fixing device according to the one embodiment.

Next, the following describes the fixing device 12 with reference to FIGS. 2 to 6. FIG. 2 schematically illustrates a planar view of an internal structure of the fixing device 12. FIG. 3 illustrates a cross-sectional view taken along the line III-III in FIG. 2. FIG. 4 schematically illustrates a planar view of an internal structure of the fixing device 12, and illustrates a state where a claw member 41 and similar member are close to the fixing nip N. FIG. 5 illustrates a cross-sectional view taken along the line V-V in FIG. 4. FIG. 6 schematically illustrates a planar view of an internal structure of the fixing device 12, and illustrates a state where the claw member 41 and similar member are separated from the fixing nip N. FIG. 7 illustrates a cross-sectional view taken along the line VII-VII in FIG. 6. FIG. 8 illustrates a control system of the fixing device 12.

As illustrated in FIGS. 2 and 3, the fixing device 12 includes a fixing frame 30, the fixing roller 31, the pressure roller 32, a fixing motor 33, a heater 34, and a separating unit 35.

The fixing roller 31 as a fixing member is formed into a cylindrical shape long in the front-rear direction. The fixing roller 31 is rotatably supported by the fixing frame 30. While the drawing is not illustrated, the fixing roller 31 is formed by laminating release layers (fluororesin) on an outer peripheral surface of a core material made of, for example, metal (aluminum, iron, or similar metal).

The pressure roller 32 as a pressure member is formed into a cylindrical shape long in the front-rear direction. The pressure roller 32 is rotatably supported by the fixing frame 30. While the drawing is not illustrated, the pressure roller 32 is formed by laminating elastic layers (for example, silicon rubber) on an outer peripheral surface of a core material made of, for example, metal (aluminum, iron, or similar metal). The pressure roller 32 includes release layers (fluororesin, not illustrated) coating the elastic layers. The pressure roller 32 is urged by an urging member (not illustrated) to be brought into pressure contact with the fixing roller 31. The fixing nip N is formed between the fixing roller 31 and the pressure roller 32.

The fixing motor 33 is connected to the fixing roller 31 via a gear train (not illustrated). The fixing motor 33 rotatably drives the fixing roller 31 about its axis. The pressure roller 32 is driven by the fixing roller 31 to rotate in a direction opposite to the fixing roller 31.

The heater 34 as heat source is, for example, a halogen heater or a ceramic heater. The heater 34 is located in an internal space of the fixing roller 31 (see FIG. 3). The heater 34 heats the fixing roller 31.

The sheet S passes through the fixing nip N while its surface on which the toner image has been transferred is opposed to the fixing roller 31 side. This melts and applies pressure to the toner image (toners that constitute the toner image) to fix on the front or back surface of the sheet S. The sheet S, which has passed through the fixing nip N, is possibly attached on (wound around) the fixing roller 31 because of an influence of the melted toners (see FIG. 3).

Thus, the separating unit 35 of the fixing device 12 is located so as to enable the sheet S, which is attached on the fixing roller 31 after passing through the fixing nip N, to be separated.

As illustrated in FIG. 3, the separating unit 35 is located opposed to the fixing roller 31 on a downstream side of the fixing nip N. The separating unit 35 includes the claw member 41 that contacts an outer peripheral surface of the fixing roller 31. The claw member 41 relatively slides on the outer peripheral surface of the rotating fixing roller 31 to remove the sheet S attached on (wound around) the fixing roller 31.

Here, a winding phenomenon of the sheet S around the fixing roller 31 easily occurs when the fixing process is performed on a tender sheet S, such as a thin paper (see FIG. 5). Additionally, this winding phenomenon possibly occurs when image formation is performed on the head side of the sheet S in the conveyance direction. That is because the sheet S is attached on the fixing roller 31 because of the melted toners. On the other hand, this winding phenomenon does not easily occur when the fixing process is performed on a tough sheet S, such as a cardboard (see FIG. 7). Thus, when the fixing process is performed on a tough sheet S, the claw member 41 is not often required. Therefore, the separating unit 35 of the fixing device 12 have a configuration that positions the claw member 41 at an appropriate position in accordance with a kind of the sheet S (for example, thickness and material), and a position of image on the sheet S.

As illustrated in FIGS. 2 and 3, the separating unit 35 includes a sliding member 40, the claw member 41, and a turning mechanism 42. The sliding member 40 and the claw member 41 are integrally formed. While the details will be described later, the turning mechanism 42 is controlled by the control device 14 to reciprocate the sliding member 40 and the claw member 41 along a rotation direction of the fixing roller 31.

The sliding member 40 includes a slide shaft 40*a* and a plurality (for example, six) of sliding elements 40*b*. It is only necessary that one or more sliding element 40*b* is located in accordance with a width of the sheet S.

The slide shaft 40*a* is formed into a columnar shape (bar shape) long in the front-rear direction. Both front and rear end portions of the slide shaft 40*a* slidably fit guide grooves G depressed on both front and rear walls of the fixing frame 30. A pair of the front and rear guide grooves G is formed into a circular arc shape along the rotation direction of the fixing roller 31 (see FIG. 3).

The respective sliding elements 40*b* are shorter than the slide shaft 40*a* in the front-rear direction and are formed into a cylindrical shape having a diameter larger than that of the slide shaft 40*a*. The plurality of sliding elements 40*b* are each secured in the front-rear direction of the slide shaft 40*a* at predetermined intervals. The respective sliding elements 40*b* are located such that the sliding elements 40*b* have centers identical to that of the slide shaft 40*a*. Each of the sliding elements 40*b* (the sliding member 40) is located in a state of contacting the outer peripheral surface (surface) of the fixing roller 31.

The claw member 41 includes a plurality (for example, six) of separation claws 41*a*. The respective separation claws 41*a* are located corresponding to the sliding elements 40*b*. Each of the separation claws 41*a* has one end portion (a base end portion) and is formed into a cantilever shape where the one end portion is secured to an upper portion of the sliding element 40*b*. The respective separation claws 41*a* are formed such that the separation claws 41*a* decrease in thickness toward the other end portions (distal end portions). The distal end portions of the respective separation claws 41*a* are formed into an acute angle viewed from front. Each of the separation claws 41*a* (the claw member 41) runs toward the fixing nip N from the sliding member 40. The claw member 41 is located in a state where the distal end portions of the respective separation claws 41*a* contact the outer peripheral surface (surface) of the fixing roller 31. The sliding member 40 and the claw member 41 are guided to the guide grooves G and turn about the rotation shaft of the fixing roller 31. The claw member 41 and the sliding member 40 are movably located along the rotation direction of the fixing roller 31.

The sliding member 40 and the claw member 41 (hereinafter referred to as "claw member 41 and similar member") are movably located between a close position P1 and a separation position P2 while being guided to the respective guide grooves G. The close position P1 is located at the proximity of the fixing nip N (see FIG. 5). The separation position P2 is located on a downstream side of the rotation direction of the fixing roller 31 with respect to the close position P1 (see FIG. 7). Between the close position P1 and the separation position P2, an intermediate position P3 is located (see FIG. 3).

As illustrated in FIGS. 2 and 3, the turning mechanism 42 includes a turning shaft 43, a pair of front and rear eccentric cams 44, a pair of front and rear tension springs 45, and a drive motor 46.

The turning shaft 43 is formed into an approximately columnar shape (bar shape) long in the front-rear direction. Accurately, the turning shaft 43 has a cross section where a part of the turning shaft 43 is cut out. The cross section has an approximately fan shape (approximately D shape) viewed from a side planar surface (see FIG. 3). The turning shaft 43 is rotatably supported by both the front and rear walls of the fixing frame 30.

The pair of the front and rear eccentric cams 44 are secured to both front and rear sides of the turning shaft 43 via boss portions 47. The respective boss portions 47 are formed into an approximately annular shape so as to penetrate through the turning shaft 43. The respective boss portions 47 are unrotatably secured to the turning shaft 43. That is, the respective boss portions 47 and the respective eccentric cams 44 integrally rotate with the turning shaft 43. The pair of the front and rear eccentric cams 44 have an identical shape. Thus the following mainly describes one of the eccentric cams 44.

As illustrated in FIG. 3, the eccentric cam 44 has one end portion (a base end portion) and is formed into a cantilever shape where the one end portion is secured to the boss portion 47. The eccentric cam 44 has a lower surface formed into an approximately fan shape (half circular shape) having a curved arc shape viewed from front. On the lower surface of the eccentric cam 44, a cam surface 44*a* is formed. The cam surface 44*a* includes a closing cam surface F1 and a separating cam surface F2.

The separating cam surface F2 is formed on the boss portion 47 side (a base end side of the eccentric cam 44), and the closing cam surface F1 is formed on a distal end side of the eccentric cam 44. The closing cam surface F1 and the separating cam surface F2 are formed as curved convex surfaces having respective different distances from a rotational center (the turning shaft 43). The closing cam surface F1 is formed so as to have a curvature larger than that of the separating cam surface F2. Between (on a connection portion of) the closing cam surface F1 and the separating cam surface F2, a depression portion F3 is formed. The depression portion F3 is depressed on a portion at which the curvatures of the two cam surfaces F1 and F2 are switched.

The eccentric cam 44 is rotatably (swingably) located in a state where the cam surface 44*a* contacts the one sliding element 40*b* (the sliding member 40). The closing cam surface F1 is configured to move the claw member 41 and similar member to the close position P1. As illustrated in FIGS. 4 and 5, in a state where the sliding element 40*b* contacts the closing cam surface F1, the claw member 41 and similar member are displaced to the close position P1. Subsequently, the separating cam surface F2 is configured to move the claw member 41 and similar member to the separation position P2. As illustrated in FIGS. 6 and 7, in a state where the sliding element 40*b* contacts the separating cam surface F2, the claw member 41 and similar member are displaced to the separation position P2. Further, the depression portion F3 is configured to move the claw member 41 and similar member to the intermediate position P3. As illustrated in FIGS. 2 and 3, in a state where the sliding element 40*b* is positioned at (fitted to) the depression portion F3, the claw member 41 and similar member are displaced to the intermediate position P3.

As illustrated in FIG. 2, the pair of the front and rear tension springs 45 as an urging member are bridged between spring receiving portions 30*a* and the slide shaft 40*a*. The spring receiving portions 30*a* are formed inside a left wall of the fixing frame 30. The tension springs 45 are located so as to urge the sliding member 40 toward the cam surface 44*a* of the eccentric cam 44. The claw member 41 and similar member are held at the respective positions P1 to P3 by a balance between urging forces of the respective tension springs 45 and forces received from the cam surfaces 44*a* (F1 and F2 (including also the depression portion F3, and the same applies to the following)) of the eccentric cams 44.

As illustrated in FIG. 3, the drive motor 46 as a driving unit is connected to the turning shaft 43 via a gear train (not illustrated). While the details will be described later, the drive motor 46 is drivingly controlled by the control device 14. This causes the turning shaft 43 to rotate in positive and negative directions. That is, the drive motor 46 swings (reciprocally rotates) the respective eccentric cams 44 about the turning shaft 43.

The multi-functional peripheral 1 includes an operation panel 50 (see FIG. 8) with which a user performs input operation. The user operates the operation panel 50 or an external terminal (not illustrated) connected to the multi-functional peripheral 1 to input a size and a kind (for example, thickness and material) of the sheet S. The multi-functional peripheral 1 includes, for example, a power source (not illustrated) that supplies the respective units with power.

Here, the above-described control device 14 includes an arithmetic processing unit (not illustrated) that executes arithmetic processing based on, for example, a program stored in a storage unit (not illustrated). As illustrated in FIG. 8, the fixing motor 33, the heater 34, the drive motor 46, and the operation panel 50 and similar unit (the respective units and similar unit) are electrically connected to the control device 14. The respective units and similar unit are appropriately controlled by the control device 14. While the drawing is not illustrated, other units and similar unit, which are required for the image formation process, are also connected to and controlled by the control device 14.

Next, with reference to FIGS. 2 to 7, the following describes an action of the separating unit 35 (displacement control of the claw member 41 and similar member). Assume that a state where the claw member 41 and similar member are displaced to the intermediate position P3 is an initial state (see FIGS. 2 and 3).

The information, which indicates a size and a kind of the sheet S and has been input by the user from the operation panel 50 or the external terminal, is transmitted to the control device 14. The control device 14 recognizes an image formation position (printing position) on the sheet S based on the image data used for the image formation process. The control device 14 controls the turning mechanism 42 in accordance with the kind of the sheet S or the position of toner image to be transferred on the sheet S.

For example, the fixing process on a sheet S, such as, what is called, a plain paper, is performed in the state (the initial state) where the claw member 41 and similar member are moved to the intermediate position P3 (see FIGS. 2 and 3).

Subsequently, for example, when the fixing process is performed on a tender and thin sheet S, or when image formation (the fixing process of a toner image) is performed on the head side of the sheet S in the conveyance direction, the claw member 41 and similar member are moved to the close position P1 (see FIGS. 4 and 5). In detail, the drive motor 46 of the turning mechanism 42 is drivingly controlled by the control device 14 to cause the turning shaft 43 (the respective eccentric cams 44) to rotate clockwise in FIG. 3. Then, the sliding member 40 is pushed rightward by the respective turning eccentric cams 44 (see FIG. 4) against the urging force of the respective tension springs 45. The sliding members 40 (respective sliding elements 40*b*) relatively slide to the closing cam surface F1 from the depression portion F3. That is, the claw members 41 and similar member are moved to the close position P1 from the intermediate position P3 (see FIGS. 4 and 5). When the claw members 41 and similar member are moved up to the close position P1, the control device 14 stops the driving of the drive motor 46.

The control device 14 performs an image formation process on a thin sheet S in a state where the claw member 41 and similar member are displaced to the close position P1. This removes the sheet S from the fixing roller 31. The closing cam surface F1 contacting the claw member 41 and similar member has a small curvature radius, and thus the respective separation claws 41*a* contact the fixing roller 31 under a large pressure (compared with a case where the separating cam surface F2 contacts the claw member 41 and similar member).

On the other hand, when the fixing process is performed on a tough and thick sheet S, the claw members 41 and similar member are moved to the separation position P2 (see FIGS. 6 and 7). In detail, in the case of the initial state, the drive motor 46 is drivingly controlled by the control device 14 to cause the respective eccentric cams 44 to rotate anticlockwise in FIG. 3. Then, the sliding members 40 (respective sliding elements 40*b*) are pressed to the respective turning eccentric cams 44 (in a left direction) by the urging forces of the respective tension springs 45. The sliding members 40 (respective sliding elements 40*b*) relatively slide to the separating cam surface F2 from the depression portion F3. That is, the claw members 41 and similar member are moved to the separation position P2 from the intermediate position P3 (see FIGS. 6 and 7). After the claw member 41 and similar member are moved up to the separation position P2, the control device 14 stops the driving of the drive motor 46.

The control device 14 performs an image formation process on a thick sheet S in a state where the claw member 41 and similar member are displaced to the separation position P2. This prevents a collision of the sheet S with the claw member 41 (the respective separation claws 41*a*).

As described above, the sliding member 40 receives both pressing forces from the respective swinging eccentric cams 44 and tensile forces from the respective tension springs 45. The claw members 41 and similar member are movably located between the close position P1 and the separation position P2 in accordance with a ratio of the pressing force to the tensile force, which are received by the sliding member 40. Then, the control device 14 controls the movement of the claw members 41 and similar member in accordance with a kind of the sheet S and a position of an image on the sheet S.

According to the above-described fixing device 12, for example, when the fixing process is performed on a thin sheet S, or when image formation is performed on the head side of the sheet S in the conveyance direction, the turning mechanism 42 moves the claw members 41 to the proximity of the fixing nip N (the close position P1). This claw members 41 remove the sheet S, which has passed through the fixing nip N, from the fixing roller 31. This prevents winding of the sheet S around the fixing roller 31. On the other hand, when the fixing process is performed on a thick sheet S, the turning mechanism 42 moves the claw members 41 to the separation position P2, which is apart from the fixing nip N. Then, this prevents the sheet S, which has passed through the fixing nip N, from colliding with the claw members 41 to ensure the reduced load provided to the fixing roller 31 by the claw member 41. This ensures the reduced damage and abrasion of the fixing roller 31. As described above, the claw member 41 is located at an appropriate position in accordance with, for example, a kind of the sheet S.

The close position P1 is configured to be positioned at a position at which the sheet S is separable from the fixing roller 31. The separation position P2 is configured to be positioned at a position at which the collision of the sheet S is preventable. The intermediate position P3 is configured to be positioned at a position at which the fixing process is appropriately performed on, what is called, a plain paper. That is, the intermediate position P3 is configured as a home position. It is preferred that the close position P1, the separation position P2, and the intermediate position P3 be positioned on the basis of, for example, outer diameters of the respective rollers 31 and 32, temperature, pressure of the fixing nip N, and properties of the toners.

Each of the sliding elements 40*b* (the sliding member 40) and each of the separation claws 41*a* (the claw member 41) contact the surface of the fixing roller 31, which enables each of the separation claws 41*a* (the claw member 41) to move while holding a constant contact angle on the surface of the fixing roller 31. Since constant contact pressure of each of the separation claws 41*a* (the claw member 41) is held, this ensures the reduced abrasion of the fixing roller 31.

According to the above-described fixing device 12, the sliding member 40 is pressed to the cam surfaces 44*a* (F1 to F3) of the respective eccentric cams 44 by the urging force of the tension springs 45. The sliding member 40 relatively slides on the cam surfaces 44*a* of the respective rotating eccentric cams 44 to cause the claw members 41 and similar member to reciprocate along the rotation direction of the fixing roller 31. Thus, employing a cam mechanism as the turning mechanism 42 ensures the stable movement of the claw member 41 and similar member.

While the respective eccentric cams 44 of the fixing device 12 according to the embodiment is configured to swing (reciprocate), the disclosure is not limited to this. For example, a circular plate cam that is rotatable by 360 degrees may be employed instead of the respective eccentric cams 44.

While the control device 14 of the fixing device 12 according to the above-described embodiment integrally controls the multi-functional peripheral 1, the disclosure is not limited to this. For example, a control unit to control the fixing device 12 may be independently provided in addition to the control device 14.

While in the respective embodiments, as one example, the above has described the case where the disclosure is applied to the multi-functional peripheral 1 (monochrome), not limited to this, the disclosure may be applied to, for example, a color printer and a facsimile.

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

What is claimed is:

1. A fixing device comprising:

a fixing member rotatably located, the fixing member being heated by a heat source;

a pressure member rotatably located, the pressure member being in a pressure contact with the fixing member to form a fixing nip; and a separating unit configured to separate a sheet from the fixing member, the sheet being attached on the fixing member when passing through the fixing nip; wherein the separating unit includes a sliding member located in a state of contacting a surface of the fixing member, a claw member running toward the fixing nip from the sliding member, the claw member having a distal end portion, the claw member being located in a state where the distal end portion contacts the surface of the fixing member, and a turning mechanism that reciprocates the sliding member and the claw member along a rotation direction of the fixing member, and the sliding member and the claw member move between a close position and a separation position along the rotation direction of the fixing member such that the sliding member and the claw member contact the surface of the fixing member at both the close position and the separation position, the close position being located at a proximity of the fixing nip, the separation position being located on a downstream side in the rotation direction of the fixing member with respect to the close position.

2. The fixing device according to claim 1, further comprising:

a control unit that controls the turning mechanism in accordance with a kind of the sheet or a position of a toner image to be transferred on the sheet.

3. The fixing device according to claim 1, wherein the turning mechanism includes:

an eccentric cam rotatably located in a state of contacting the sliding member;

an urging member that urges the sliding member to a cam surface of the eccentric cam; and a driving unit drivingly controlled by the control unit to cause the eccentric cam to rotate.

4. The fixing device according to claim 3, wherein the cam surface of the eccentric cam includes:

a closing cam surface that moves the sliding member and the claw member into the close position; and a separating cam surface that moves the sliding member and the claw member into the separation position; wherein between the closing cam surface and the separating cam surface, a depression portion is formed, the depression portion moving the sliding member and the claw member to an intermediate position located between the close position and the separation position.

5. An image forming apparatus comprising:

an image forming unit that transfers a toner image on a sheet; and the fixing device according to claim 1, the fixing device fixing the toner image on the sheet.

6. The fixing device according to claim 1, wherein the sliding member and the claw member are formed integrally with each other as a single-piece member.

* * * * *